US010818443B2

(12) United States Patent
Liu et al.

(10) Patent No.: US 10,818,443 B2
(45) Date of Patent: Oct. 27, 2020

(54) DUAL POWER SUPPLY TRANSFER SWITCH AND SWITCHING MECHANISM THEREOF

(71) Applicant: SCHNEIDER ELECTRIC INDUSTRIES SAS, Rueil-Malmaison (FR)

(72) Inventors: Zhenzhong Liu, Shanghai (CN); Xiaojing Zeng, Shanghai (CN)

(73) Assignee: Schneider Electric Industries SAS, Rueil Malmaison (FR)

( * ) Notice: Subject to any disclaimer, the term of this patent is extended or adjusted under 35 U.S.C. 154(b) by 0 days.

(21) Appl. No.: 16/401,482

(22) Filed: May 2, 2019

(65) Prior Publication Data

US 2019/0341203 A1 Nov. 7, 2019

(30) Foreign Application Priority Data

May 4, 2018 (CN) ..... 2018 1 0421035

(51) Int. Cl.
*H01H 3/46* (2006.01)
*H01H 9/26* (2006.01)

(52) U.S. Cl.
CPC ..... *H01H 3/46* (2013.01); *H01H 9/26* (2013.01); *H01H 2300/018* (2013.01)

(58) Field of Classification Search
CPC ..... H01H 2300/018; H01H 5/06; H01H 3/30; H01H 3/3047; H01H 3/3052; H01H 3/46;
(Continued)

(56) References Cited

U.S. PATENT DOCUMENTS 5,438,176 A 8/1995 Bonnardel et al.
7,667,154 B2 * 2/2010 Dolinski ..... H01H 3/30 200/400

(Continued)

FOREIGN PATENT DOCUMENTS

DE 102009034627 9/2010
EP 0593371 4/1994

OTHER PUBLICATIONS

English Language Machine Translation of the Abstract for German Patent Publication No. DE102009034627, published on Sep. 9, 2010, 1 page.

(Continued)

*Primary Examiner* — Vanessa Girardi
(74) *Attorney, Agent, or Firm* — Locke Lord LLP

(57) ABSTRACT

A switching mechanism for a dual power supply transfer switch. The switching mechanism has a switching assembly, which includes a driving plate, a driving rod, an actuator and an auxiliary mechanism. The driving plate includes an arc-shaped driving groove. The driving rod extends into the driving groove. The auxiliary mechanism includes a spring. The driving plate is able to rotate under an external force. The driving groove bypasses the driving rod when an end of the driving groove does not contact the driving rod, and the driving groove pushes the driving rod to rotate over a first angle and urges the spring to deform when the end of the driving groove contacts the driving rod. The spring recovers and drives the driving rod to rotate over a second angle after the spring having passed a dead point, thus causing the actuator turning on or off a first power supply. The switching mechanism also includes another switching assembly for switching a second power supply. A dual power supply transfer switch including the switching mechanism also is provided.

12 Claims, 8 Drawing Sheets

(58) Field of Classification Search
CPC .. H01H 9/24; H01H 9/26; H01H 9/54; H01H 9/56; H02J 3/005; H02J 9/04
See application file for complete search history.

(56) References Cited

U.S. PATENT DOCUMENTS

| | | | |
|---|---|---|---|
| 2005/0150754 | A1 | 7/2005 | Sirajtheen et al. |
| 2008/0245645 | A1 | 10/2008 | Dolinski |
| 2012/0103766 | A1 | 5/2012 | Hoepfl et al. |
| 2017/0054293 | A1 | 2/2017 | Dolinski et al. |

OTHER PUBLICATIONS

Extended European Search Report for European Patent Application No. 19305564.7 dated Oct. 10, 2019, 9 pages.

* cited by examiner

DUAL POWER SUPPLY TRANSFER SWITCH AND SWITCHING MECHANISM THEREOF

TECHNICAL FIELD

The present disclosure relates to a switching mechanism for a dual power supply transfer switch, and a dual power supply transfer switch including said switching mechanism.

BACKGROUND

Dual power supply transfer switches are widely used in emergency power supply systems, which can automatically or manually switch load circuits from one power supply to another according to the condition of power circuit, such as switching between main power and backup power to maintain the load circuit operating continuously and reliably. One type of dual power supply transfer switch has three working positions, namely, a first power position for turning on a first power supply, a second power position for turning on a second power supply, and a duel dividing position for simultaneously turning off the first and second power supplies. The duel dividing position can meet the user's needs for delay, safety maintenance and so on.

The switching mechanism is a crucial component in the dual power supply transfer switch for receiving a manual or automatic driving force to perform switching between the first power position, the second power position, and the duel dividing position. When performing manual switching, if the switching speed is slow, the burning time of the arc generated when the current is broken is long or even cannot be quenched at all, which may cause fire, burning operators, burning out switch devices and the like. Therefore, the switching mechanism is required to enable manual-irrelevant switching to avoid uncontrollable switching speeds which causes safety accidents. The structures of the prior art manual-irrelevant switching mechanisms are complicated, resulting in high manufacturing cost, inconvenient operation and maintenance, and affecting the reliability of the dual power supply transfer switch.

To this end, it is desired to provide a switching mechanism for a dual power supply transfer switch having a simple structure to solve the problems in the prior arts.

SUMMARY

The present invention aims to solve the above mentioned problems. To this end, in the first aspect of the invention, a switching mechanism for a dual power supply transfer switch is provided.

The switching mechanism includes a first switching assembly, which includes a first driving plate, a first driving rod, a first actuator and a first auxiliary mechanism. The first driving plate includes an arc-shaped first driving groove and the first driving rod extends into the first driving groove. The first auxiliary mechanism includes a first spring. The first driving plate is able to rotate under an external force. The first driving groove bypasses the first driving rod when an end of the driving groove does not contact the first driving rod; and the first driving groove pushes the first driving rod to rotate over a first angle and urges the first spring to deform when the end of the driving groove contacts the first driving rod. The first spring recovers and drives the first driving rod to rotate over a second angle after the first spring having passed a dead point, thus causing the first actuator turning on or off a first power supply.

Based on this solution, during a manual switching process, a manual force is only required when the first driving rod rotates over the first angle while the first power supply remains not switched. However, the manual force is not required any more when the first driving rod rotates over the second angle, because the first spring having passed the dead point may drive the first driving rod to continue rotating, so that the first power supply can be switched manual-irrelevantly.

Further, the switching mechanism further comprises a second switching assembly, which include a second driving plate, a second driving rod, a second actuator and a second auxiliary mechanism. The second driving plate includes an arc-shaped second driving groove, and the second driving rod extends into the second driving groove. The second auxiliary mechanism includes a second spring. The second driving plate is able to rotate under an external force. The second driving groove bypasses the second driving rod when an end of the second driving groove does not contact the second driving rod, and the second driving groove pushes the second driving rod to rotate over a first angle and urges the second spring to deform when the end of the second driving groove contacts the second driving rod. The second spring recovers and drives the second driving rod to rotate over a second angle after the second spring having passed a dead point, thus causing the second actuator turning on or off a second power supply.

Based on this solution, the second power supply can also be switched manual-irrelevantly.

Further, the first driving plate and the second driving plate are disposed around one and the same rotation axis X. The first and second driving plates are interlocked with each other to rotate together.

Optionally, the first driving plate and the second driving plate are interlocked by a connection block having a non-circular section shape, wherein one portion of the connection block is inserted into a first receiving slot at a center of the first driving plate, and another portion of the connection block is inserted into a second receiving slot at a center of the second driving plate.

Optionally, the first driving plate and the second driving plate are interlocked by a connection rod, wherein one end of the connection rod is inserted into a first receiving hole away from the center of the first driving plate, and the other end of the connection rod is inserted into a second receiving hole away from the center of the second driving plate.

Further, the first driving groove and the second driving groove are offset from each other in the circumferential direction about the rotation axis by an angle such that when the first driving groove pushes the first driving rod to rotate over the first angle, the second driving groove bypasses the second driving rod; and when the second driving groove pushes the second driving rod to rotate over the first angle, the first driving groove bypasses the first driving rod.

Based on this solution, the first driving plate and the second driving plate rotate simultaneously, but the switching of the first power supply and the second power supply occur separately in different time periods.

Optionally, the first angle is equal to the second angle and half of the extending angle of the first driving groove and the second driving groove.

Optionally, the first driving plate is connected to a manual operating part for receiving a manually applied external force in order to drive the first driving plate and the second driving plate to rotate together.

Optionally, the first driving plate is provided with an automatic operation part for receiving an external force applied by an automatic driving mechanism in order to drive the first driving plate and the second driving plate to rotate together.

Further, when the first driving plate and the second driving plate are driven to rotate at a first time, the dual power supply transfer switch is switched from a first position to a duel dividing position. In the first position, the first power supply is turned on and the second power supply is turned off. In the duel dividing position, the first power supply and the second power supply are both turned off. When the first driving plate and the second driving plate are driven to rotate at a second time, the dual power supply transfer switch is switched from the duel dividing position to a second position. In the second position, the first power supply is turned off and the second power supply is turned on.

Based on this solution, the first driving plate and the second driving plate rotate simultaneously, but switching operations between the first power position, the second power position, and the duel dividing position can be realized as needed. In addition, the first power supply and the second power supply cannot be turned on at the same time.

Optionally, each of the first actuator and the second actuator includes an actuating plate having an actuating groove, wherein a corresponding driving rod extends into the actuating groove and can slide along the actuating groove. The driving rod drives the actuating plate to rotate when the driving rod contacts one end of the actuating groove. Two linkages are further included, wherein one end of each linkage is hinged to the actuating plate, and the other end is connected to a corresponding movable contact, such that the movable contact rotates with the rotation of the actuating plate, and becomes connected or disconnected with a stationary contact of a corresponding one of the first power supply or the second power supply.

Optionally, each of the first auxiliary mechanism and the second auxiliary mechanism includes a mounting plate. A corresponding driving rod is able to rotate around a center of the mounting plate. A telescopic rod has a variable length with a fixed end of the telescopic rod being rotatably coupled to the mounting plate at a position away from the center, and a movable end of the telescopic rod being coupled to the corresponding driving rod. A spring is disposed between the fixed end and the movable end of the telescopic rod. The spring is configured to deform and store a potential energy when the telescopic rod rotates closer to the line between the fixed end of the telescopic rod and the center of the mounting plate; and to recover and release the potential energy when the telescopic rod rotates further from the line between the fixed end of the telescopic rod and the center of the mounting plate.

Optionally, the first driving plate may be located between the first actuator and the first auxiliary mechanism; the second driving plate may be located between the second actuator and the second auxiliary mechanism; and the first actuator and the second actuator may be located between the first driving plate and the second driving plate.

A second aspect of the invention provides a dual power supply transfer switch comprising a switching mechanism as discussed above.

Some preferred modes and embodiments for carrying out the invention as defined by the appended claims are described in detail hereinafter by referring to the accompanying drawings. Then, the above features and advantages, as well as other features and advantages of the present invention, can be readily understood.

DETAILED DESCRIPTION

Figure 1:
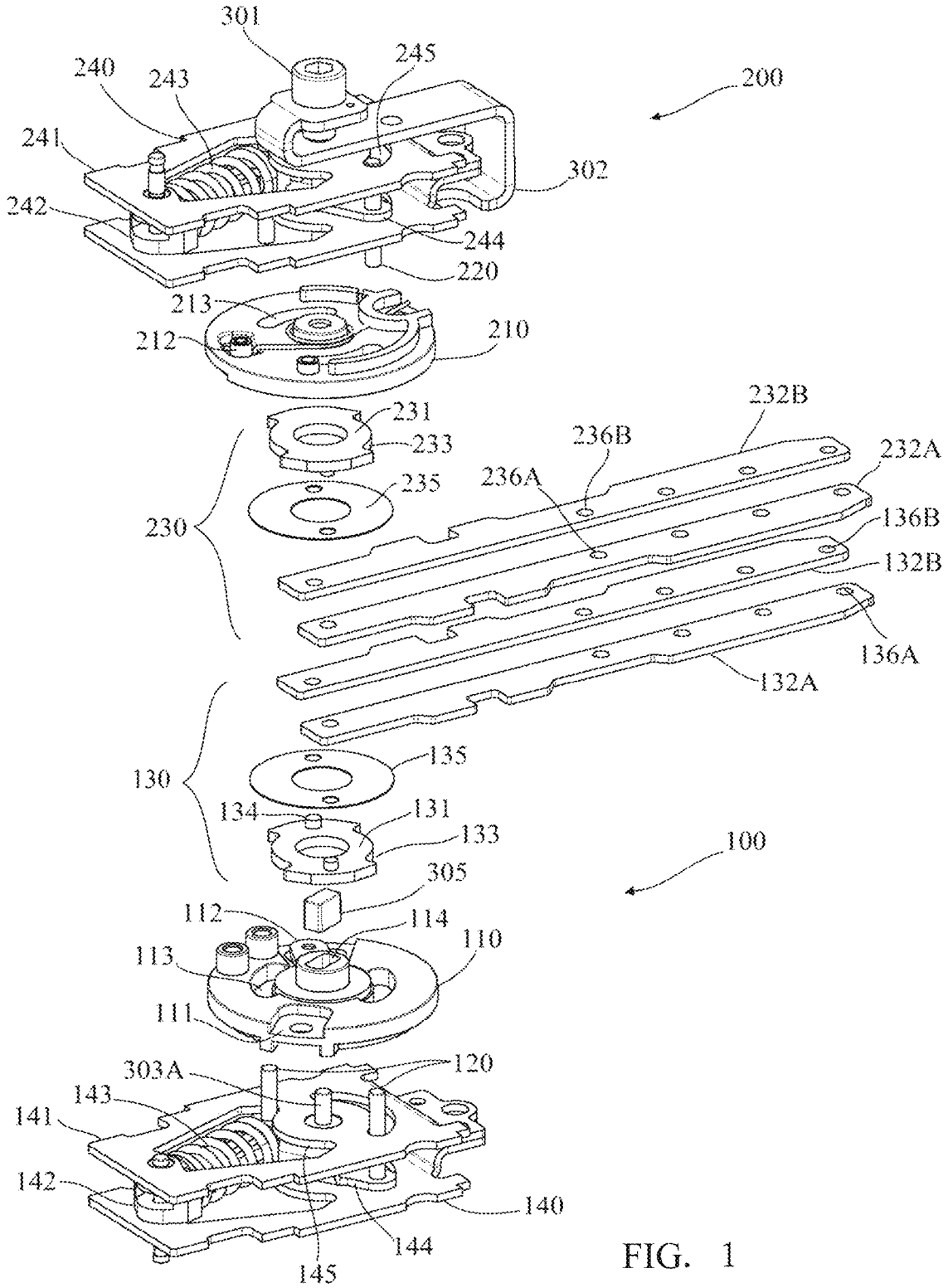
FIG. 1 shows an exploded perspective view of a switching mechanism according to a first embodiment.

Some embodiments of a switching mechanism for a dual power supply transfer switch according to the present invention will be described below with reference to the accompanying drawings. In the drawings, the same or similar elements are denoted by similar reference numerals (for example, the elements identified by "1XX" and "2XX" have same structures and/or similar functions). For the sake of clarity, the drawings only show the main elements in the switching mechanism, while the other elements well known to those skilled in the art are not shown. In the description hereinafter, the terms "left", "right," "upper", "lower", etc. are used to describe the relative orientations of the elements, and the terms "first", "second", "one", "another", etc. are used to differentiate similar elements. These and other similar terms are not intended to limit the scope of the invention.

FIG. 1 shows an exploded perspective view of a switching mechanism for a dual power supply transfer switch in accordance with the present invention. As shown in FIG. 1, the switching mechanism includes a first switching assembly 100 and a second switching assembly 200, wherein the first switching assembly 100 is used to turning on/off the first power supply, and the second switching assembly 200 is used to turning on/off the second power supply. The structure and operation of the first and second switching assemblies 100, 200 are identical. Thus, various descriptions below for the first switching assembly 100 can are be applied for the second switching assembly 200.

As shown in FIG. 1, the first switching assembly 100 includes a first driving plate 110, a first driving rod 120, a first actuator 130, and a first auxiliary mechanism 140. The first driving plate 110 can be rotated under an externally applied driving force. The force may be a manual driving force from an operator or an automatic driving force from an automatic driving device (for example, an electromagnetic driving device, a motor-gear driving device, etc.). The first driving plate 110 can drive the first driving rod 120 to rotate, and the first driving rod 120 can in turn act on the first actuator 130 to cause turning on or off the first power supply. The first auxiliary mechanism 140 can drive the first driving rod 120 such that the actuation process of the first actuator 130 can be separated from the rotation process of the first driving plate 110. Therefore, in multiple switching operations of transfer switch, although the rotational speeds of the first driving plate 110 may be different, the actuation speed of the first actuator 130 can be kept consistent, thereby avoiding any adverse influence of the driving force difference on the switching performance. In particular, in the case of manual operation, the current cutting off speed remains the same regardless of the manual force, such that a dangerous long-term arc due to cutting off slowly can be avoided. Thus, a manual irrelevant switching is realized.

The first driving plate 110 is a round plate-shaped member that is rotatable about a rotation axis X and disposed between the first actuator 130 and the first auxiliary mechanism 140. As shown in FIG. 1, the driving plate 110 is provided with a notch 111, which is to engage with a driving arm 302 that transmits manual force. Thereby, the driving plate 110 can be rotated by a manual force from an operator; in addition, the driving plate 110 is provided with a protuberance 112 for receiving an automatic driving force (also referring to protuberance 212 of the second driving plate 210). The protuberance 112 is to mates with an armature (not shown) of an electromagnetic driving device, which can be rotated when moving the armature. Further, the driving plate 110 has a curved driving groove 113, which extends over a certain angle in circumferential direction about the rotation axis X. The first driving plate 110 may have two driving grooves 113 symmetrically arranged about the rotation axis X, wherein each driving groove 113 is for receiving a driving rod 120 therethrough and allowing the driving rod 120 to move along the respective groove 113 between two opposite ends. When the driving plate 110 rotates about the rotation axis X, the driving groove 113 is able to bypass the corresponding driving rod 120 without interfering with the same and leaving it stationary. Further, when the driving groove 113 rotates to a position where it contacts with the driving rod 120 at one end thereof, the driving groove 113 is able to push the driving rod 120 to rotate together. Thus, when the driving plate 110 is manually or automatically rotated, depending on the position of the driving rod 120 relative to the driving plate 110, the driving rod 120 can remain stationary or rotate by the driving plate 110.

Figure 2:
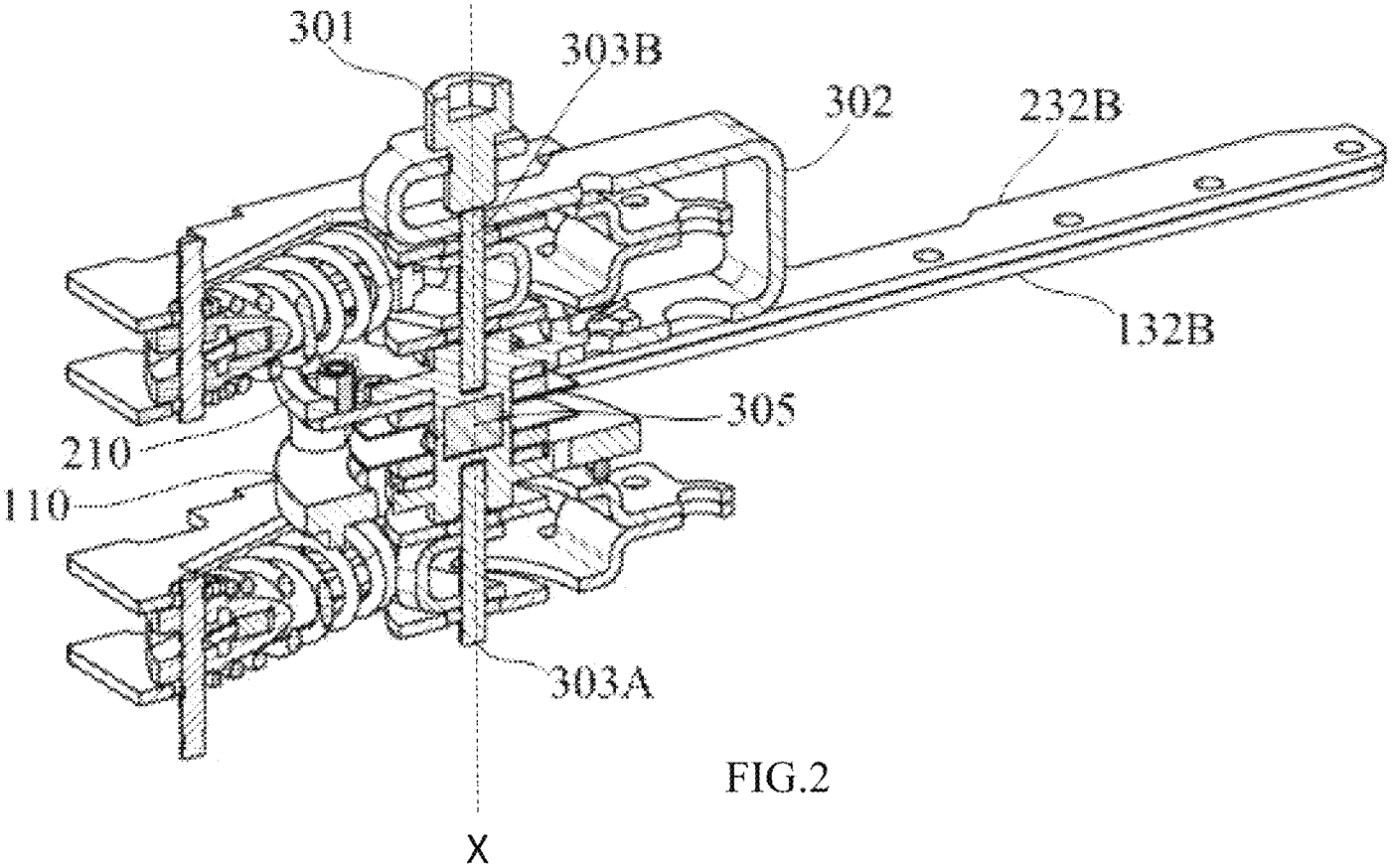
FIG. 2 shows an assembled perspective view of the switching mechanism according to the first embodiment.

The first driving rod 120 passes through the first driving plate 110 with its upper end mated to the first actuator 130. As shown in FIG. 1, the actuator 130 is a linkage mechanism that includes an actuating plate 131 and two parallel linkages 132A and 132B. The actuating plate 131 has a general round shape around the rotation axis X, and includes an arc shaped actuating groove 133 which is disposed on the periphery of the actuating plate 131. As shown in FIG. 1 and FIG. 2, the actuating plate 131 includes two actuating grooves 133 symmetrically disposed about the rotation axis X with each actuating groove 133 receiving an upper end of a driving rod 120. The upper end of the driving rod 120 extends into the corresponding actuating groove 133 and can slide along the actuating groove 133. When the driving rod 120 slides to a position where it contacts the end of the actuating groove 133, the driving rod 120 can push the actuating plate 131 to rotate together. In addition, the upper surface of the actuating plate 131 is provided with two symmetrical projections 134, each of which can be inserted into a respective hinge hole at the proximal end of a respective linkage 132A or 132B, so that each of the linkages 132A, 132B can be pivotably connected to the actuating plate 131. Alternatively, a spacer 135 may be provided between the linkages 132A, 132B and the actuating plate 131.

As shown in FIG. 1, one linkage 132A is provided with at least one positioning holes 136A at the distant end, and the other linkage 132B is provided with the same number of corresponding positioning holes 136B, which are located at the same distances from the hinge hole as the holes 136A. The first movable contact 401 for the first power supply may be disposed between one pair of positioning holes 136A and 136B at the same distance (see FIG. 6). The contact 401 can be disposed at different positions due to multiple pairs of positioning holes 136A, 136B. Thus, the first movable contact 401, the two linkages 132A, 132B, and the actuating plate 131 together constitute a parallelogram-shaped four-bar linkage mechanism, whereby the two linkages 132A, 132B moves in opposite directions when the actuating plate 131 is rotated by an angle about the rotation axis X, causing the first movable contact 401 rotating same angle about its own center. Rotation of the actuating plate 131 in different directions causes the first movable contact 401 to switch back and forth between two different angular orientations, wherein the first movable contact 501 contacts the first stationary contact of the first power supply in the first angular orientation, and separates from the first stationary contact 501 in the second angular orientation (see FIG. 7 and FIG. 8), thereby enabling turning on or off the first power supply.

The first driving rod 120 passes through the first driving plate 110 with its lower end mated to the first auxiliary mechanism 140. As shown in FIG. 1, the first auxiliary mechanism 140 includes a mounting plate 141, a telescopic rod 142, a spring 143, and a supporting plate 144. The mounting plate 141 is formed with a U-shape by joining two formed sheets at one side. The telescopic rod 142 is located inside the mounting plate 141 with its fixed end pivotally coupled to the mounting plate 141 and its movable end coupled to the lower end of the driving rod 121. The length of the telescopic rod 142 can be changed, and the spring 143 sleeves around telescopic rod 142 and elastically abuts against the fixed end and the movable end, such that the telescopic rod 142 always has a tendency to elongate. The supporting plate 144 is located inside the mounting plate 141. The supporting plate 144 is connected to the aforementioned two driving rods 120 at two opposite ends. The supporting plate 144 sleeves around the first main shaft 303A at its intermediate position in order to rotate around the rotation axis X. The mounting plate 141 has two arcuate guiding grooves 145 that are symmetrical about the first main shaft 303A. As shown in FIG. 1, each of the two driving rods 120 passes through the respective guiding groove 145 of the mounting plate 141, then through the respective driving groove 113 of the first driving plate 110 and the respective actuating groove 133 of the actuating plate 131. Thus, the supporting plate 144 can more stably support the two driving rods 120 to slide along the respective guiding grooves 145 in synchronization. When the driving rod 120 drives the movable end of the telescopic rod 142 to rotate from one end of the guiding groove 145 to the intermediate position closest to the fixed end of the telescopic rod 142, the length of the telescopic rod 142 is gradually shortened to the shortest, at the same the spring 143 is compressed and stores potential energy. Then, after the driving rod 120 passes over said intermediate position, the spring 143 recovers and releases the stored energy, causing the length of the telescopic rod 142 to elongate, and pushing the movable end of the telescopic rod 142 and thus the driving rod 120 toward the other end of the guiding groove 145. In said intermediate position, the telescoping rod 142 is collinear with its fixed end and the rotation axis X, thereby causing the spring 143 to have the greatest degree of deformation. This position is called as a "dead point" position of the spring 143. Although the present embodiment shows the spring 143 recovers after having been compressed first, it may be configured to recover after having been stretched first in other embodiments. That is to say, the movable end of the telescopic rod 142 may pass the rotation axis X from the outside.

In the present invention, as to the first switching assembly 100, the first driving plate 110 and the first auxiliary mechanism 140 cooperatively drive the first driving rod 120 to complete a rotation stroke, and realize a manual-irrelevant actuation of the first actuator 130. Each complete rotation stroke includes the following preparation stage and actuation stage.

preparation stage: the first driving plate 110 is driven to rotate by an external force (manually or automatically). As the first driving plate 110 rotates, the first driving rod 120 is not pushed to rotate until an end of the driving groove 113 contacts the first driving rod 120. During this stage, the first driving rod 120 moves toward the intermediate position along the guiding groove 145 of the mounting plate 141, causing the length of the telescopic rod 142 shortening, and causing the spring 142 being compressed and restoring potential energy. Meanwhile, the first driving rod 120 slides along the actuating groove 133 of the actuating plate 131 but does not reach the end of the actuating groove 133. Thus, in the preparation stage, the external force acting on the first driving rod 120 causes the spring 142 to deform and store potential energy without triggering the actuation of the first actuator 130. Then, the first power supply does not be switched.

actuation stage: when the first driving rod 120 passes the intermediate position, it turns to the actuation stage. During this stage, as the "dead point" position has been passed, the spring 142 releases the potential energy and recovers the deformation, thus causing the length of the telescopic rod 142 to elongate, and pushing the first driving rod 120 to move away from the intermediate position along the guiding groove 145 of the mounting plate 141. At the same time, the first driving rod 120 continues to slide along the actuating groove 133 of the actuating plate 131 in the first actuator 130 and finally reaches the end of the actuating groove 133. Then, the actuating plate 131 is rotated by the driving rod 120. Thus, in the actuation stage, the spring 142 releases the potential energy to act on the first driving rod 120 and triggers the actuation of the first actuator 130 to switch the first power supply.

In the case of manual operation, in one complete stroke of the first driving rod 120, the preparation stage is manual-relevant because the operations of different operators may cause fast or slow preparation stages. However, the actuation stage is manual-irrelevant, because the switching of first power supply is done exclusively by the first spring 142 with a constant switching speed independent of the operators' operations. Therefore, when the current of the first power supply is cut off, the burning time of the arc caused is short and controllable, the possibility of fire is reduced, and the safety of the dual power supply transfer switch is remarkably improved.

The dual power supply transfer switch of the present invention can be successively switched between three positions of a first power position, a duel dividing position, and a second power position. In the first power position, the first movable contact 401 contacts the stationary contact 501 of the first power supply, but the second movable contact 402 does not contact the stationary contact 502 of the second power supply; in the duel dividing position, the first movable contact 401 does not contact the stationary contact 501 of the first power supply, and the second movable contact 402 does not contact the stationary contact 502 of the second power supply, either; in the second power position, the first movable contact 401 does not contact the stationary contact 501 of the first power supply, but the second movable contact 402 contacts the stationary contact 502 of the second power supply. In order to switch the first movable contact 401 and the second movable contact 402, the switching mechanism of the present invention includes a first switching assembly 100 for switching the first power supply and a second switching assembly 200 for switching the second power supply. Both are identical in structure for ease of manufacture, use, and maintenance. Moreover, the first and second switching assembly 100,200 cooperate with each other to prevent the first power supply and the second power supply from being turned on at the same time, as described below.

FIG. 2 is a sectional perspective view showing an assembled state of the switching mechanism. The first switching assembly 100 and the second switching assembly 200 are arranged up and down along the same axis X. The linkage 132B of the first actuator 130 and the linkage 232B of the second actuator 230 are close to each other or even rest on each other. The first main shaft 303A of the first switching assembly 100 and the second main shaft 303B of the second switching assembly 200 are aligned along the same axis X. A manual operation part 301 (for example, a hexagon socket bolt) for manual operation is disposed outside the outer casing (not shown) of the dual power supply transfer switch, which is coupled to the upper end of the U-shaped driving arm 302. The U-shaped body of the driving arm 302 bypasses the second auxiliary mechanism 240, and the lower end thereof is bolted to the notch 211 on the second driving plate 210. Thus, when the manual operation part 301 is rotated by a tool such as a handle or a wrench, the driving arm 302 can be rotated to urge the second driving plate 210 to rotate. In order to simplify the structure, the first driving plate 110 and the second driving plate 210 in the present invention are interlocked. Therefore, when the second driving plate 210 rotates, the first driving plate 110 rotates with the same.

The present disclosure provides two embodiments for interlocking the first driving plate 110 and the second driving plate 210. In the first embodiment, as shown in FIG. 1 and FIG. 2, a connection block 305 is disposed between the first driving plate 110 and the second driving plate 210. The connection block 305 may have a non-circular outline such as a hexagonal shape, a rectangular shape, or the like. A first and lower portion of the connection block 305 is engaged within the first receiving slot 114 at the center of the first driving plate 110, and a second and upper portion of the connection block 305 is engaged within the second receiving slot 214 at the center of the second driving plate 210. Thereby, the rotation of the second driving plate 210 can be transmitted to the first driving plate 110 via the connection block 305. In this embodiment, since the connection block 305 is disposed along the axis X, the first main shaft 303A and the second main shaft 303B are two separate shafts.

Figure 3:
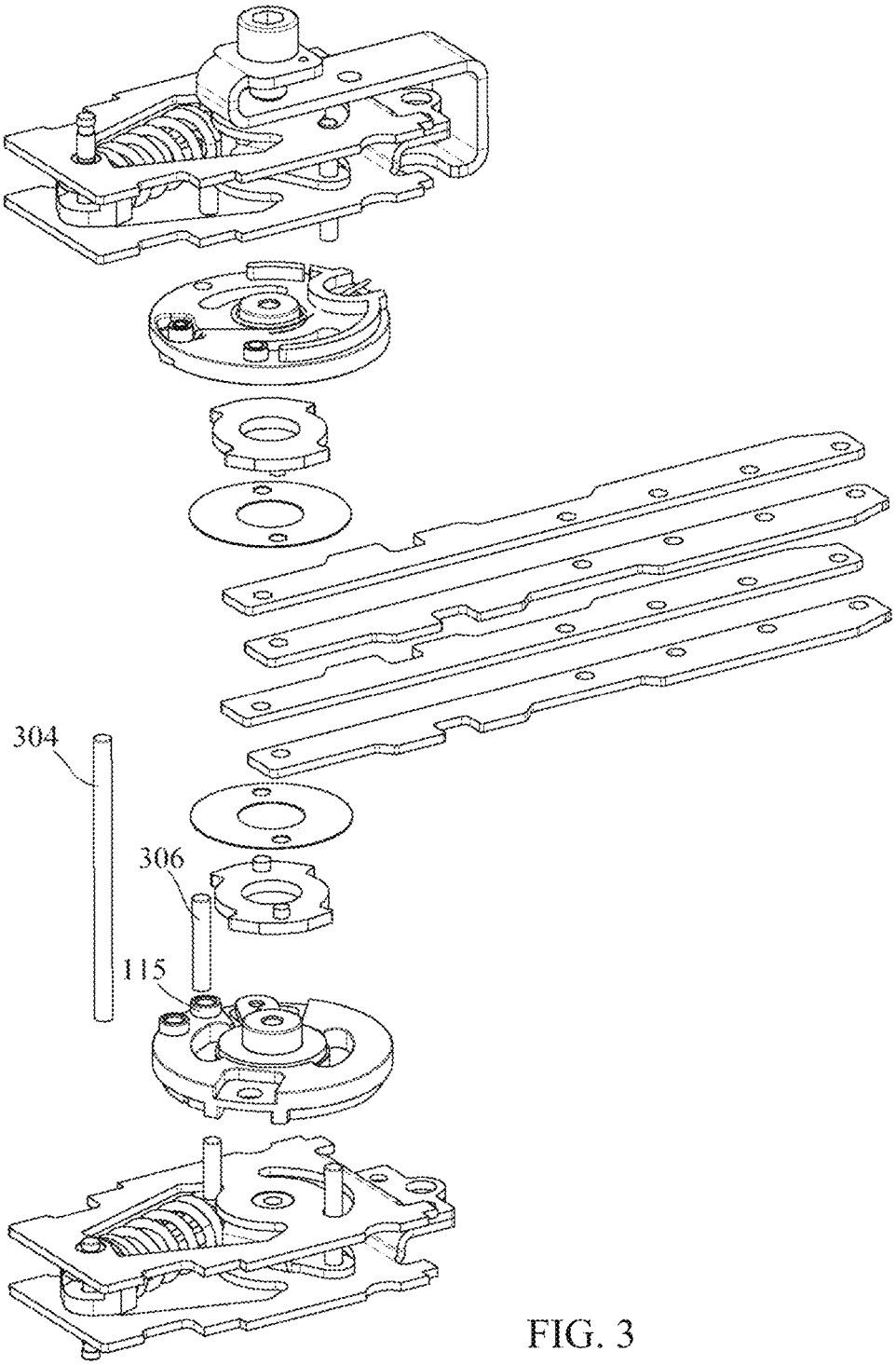
FIG. 3 shows an exploded perspective view of a switching mechanism according to a second embodiment.
Figure 4:
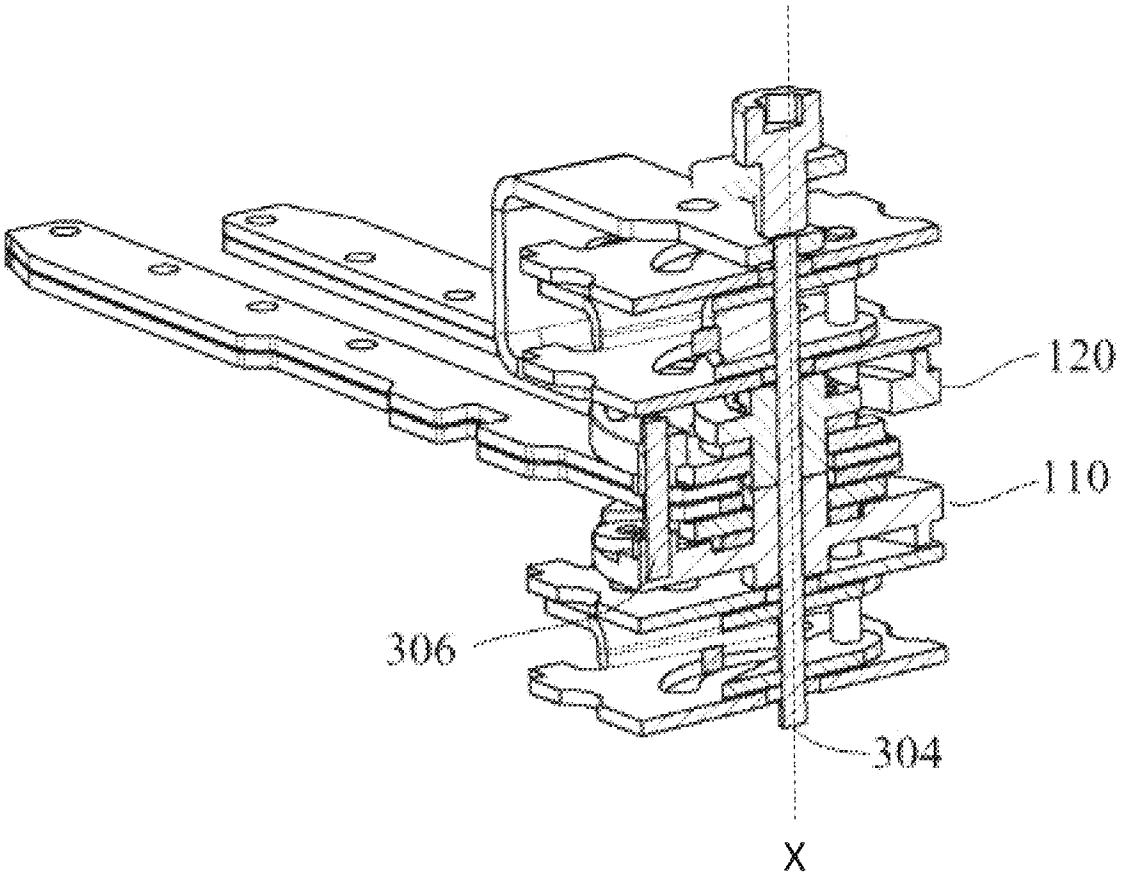
FIG. 4 shows an assembled perspective view of the switching mechanism according to the second embodiment.

FIG. 3 and FIG. 4 respectively show exploded and assembled perspective views of the switching mechanism in accordance with the second embodiment of the present invention. The switching mechanisms in the first and second embodiments are basically same except that one and same main shaft 304 is used in the second embodiment instead of the two separated main shafts 303A and 303B in the first embodiment. The components of the first switching assembly 100 and the second switching assembly 200 are all sleeved on the same shaft 304. In this case, a first receiving hole 115 and a second receiving hole 215 are provided at positions away from the centers of the first driving plate 110 and the second driving plate 210, respectively. Two opposite ends of a connection rod 306 are inserted into the two receiving holes 115 and 215, respectively. Thereby, the first driving plate 110 and the second driving plate 210 can be rotated together via the connection rod 306. In another embodiment not shown, more than one connection rods may be provided between the first and second driving plates 110 and 210.

In order to achieve sequential switching from the first power position to the duel dividing position and then to the second power position (or the reverse direction), it is necessary to allow the first and second driving plates 110, 120 driving the first and second driving rods 120, 220, separately. To this end, the present invention provides an angular difference in the circumferential direction around the rotation axis X between the driving grooves 113 and 213 on the first and second driving plate 110 and 210, which may be 45 degrees, 60 degrees or 75 degrees and so on.

Figure 5:
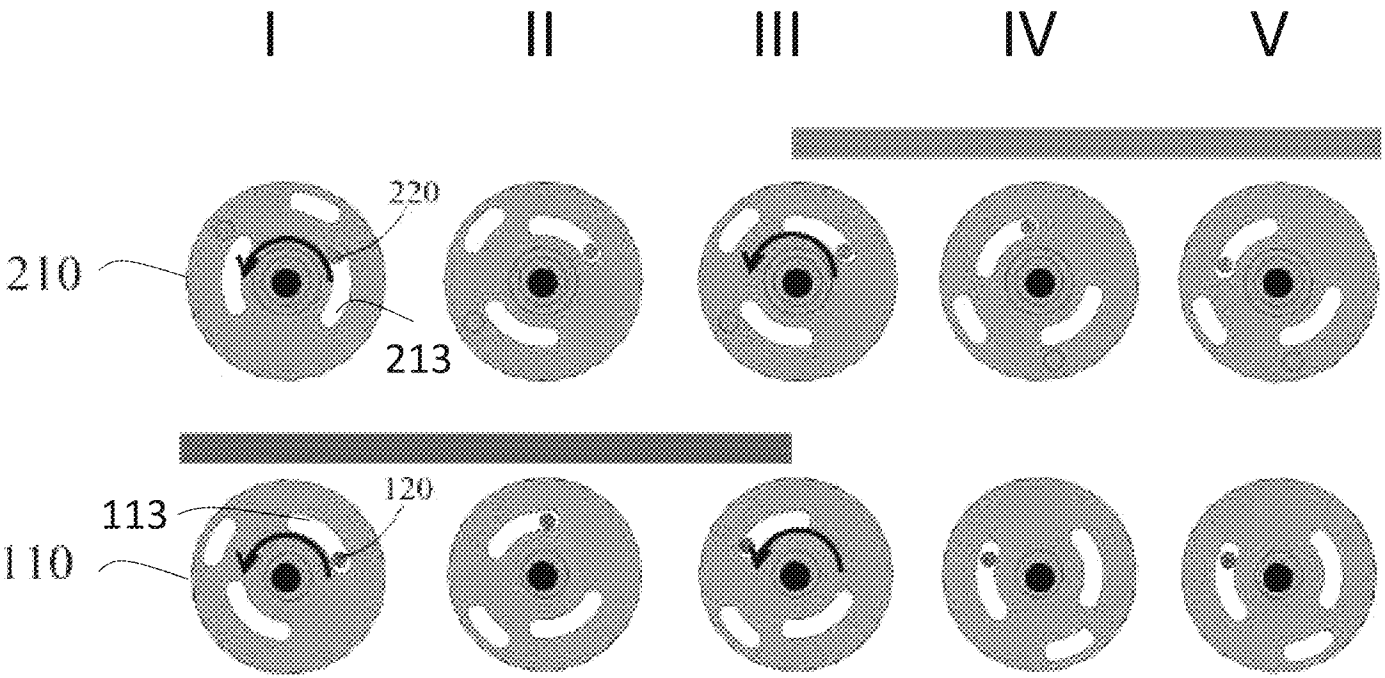
FIG. 5 illustrates the relative positions between the first driving plate and the first driving rod, as well as those between the second driving plate and the second driving rod during switching operations.

FIG. 5 shows the relative position between the first driving plate 110 and the first driving rod 120, as well as the relative position the second driving plate 210 and the second driving rod 220 during two consecutive switching operations. The first driving plate 110 and the first driving rod 120 are shown in the lower row, and the second driving plate 210 and the second driving rod 220 are shown in the upper row. Five different states of the switching mechanism during it rotates counterclockwise are sequentially shown from left to right, wherein the column I corresponds to the first power position; the column II corresponds to a position where the spring 142 in the first auxiliary mechanism 140 is at the "dead point" position; the column III corresponds to the duel dividing position; the column IV corresponds to a position where the spring 242 in the second auxiliary mechanism 240 is at the "dead point" position; and the column V corresponds to the second power position.

The state variation process from the column I to the column II corresponds to the preparation stage of the first driving rod 120. During this stage, the manual driving arm 302 or an automatic driving device is operated to drive the first driving plate 110 and the second driving plate 210 to rotate. The first driving plate 110 drives the first driving rod 120 to rotate over a first angle through the first driving groove 113. The first spring 142 is then caused to deform and store energy. During this stage, the second driving groove 213 of the second driving plate 210 bypasses the second driving rod 220, and the second driving rod 220 then remains stationary.

The state variation process from the column II to the column III corresponds to the actuation stage of the first driving rod 120. During this stage, the first driving plate 110, the second driving plate 210, and the second driving rod 220 are all kept stationary; and the first spring 142 recovers and releases energy, and drives the first driving rod 120 to rotate over a second angle along the first driving groove 113, simultaneously triggering the actuation of the first actuator 130 and cutting off the first power supply to achieve the dual dividing position.

The state variation process from the column III to the column IV corresponds to the preparation stage of the second driving rod 220. During this stage, the driving arm 302 or an automatic driving device is operated to drive the first driving plate 110 and the second driving plate 210 to go on rotating. The second driving plate 210 drives the second driving rod 220 to rotate over a first angle through the second driving groove 213. The second spring 242 is caused to deform and store energy. During this stage, the first driving groove 113 of the first driving plate 110 bypasses the first driving rod 120, and the first driving rod 120 remains stationary.

The state variation process from the column IV to the column V corresponds to the actuation stage of the second driving rod 220. During this stage, the first driving plate 110, the second driving plate 210, and the first driving rod 220 are all kept stationary; and the second spring 242 recovers and releases energy, and drives the second driving rod 220 to rotate over a second angle along the second driving groove 213, simultaneously triggering the actuation of the second actuator 230 and turning on the second power supply to achieve the second power position.

Figure 6:
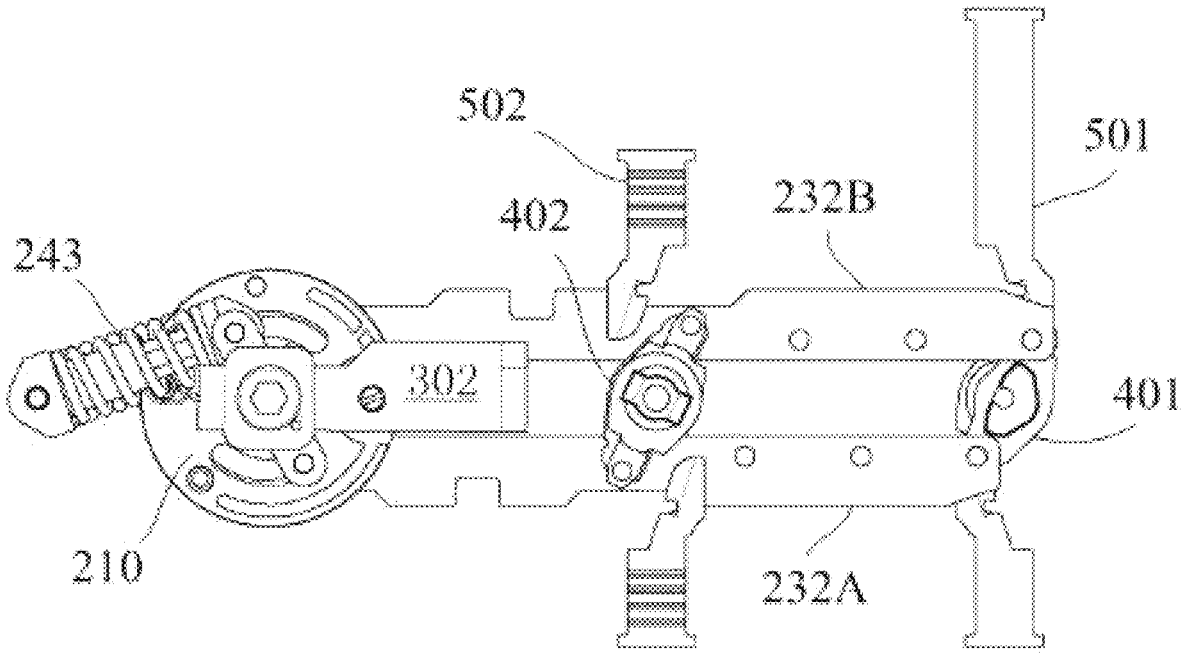
FIG. 6 shows a partial top view of a dual power supply transfer switch in a first power position.
Figure 7:
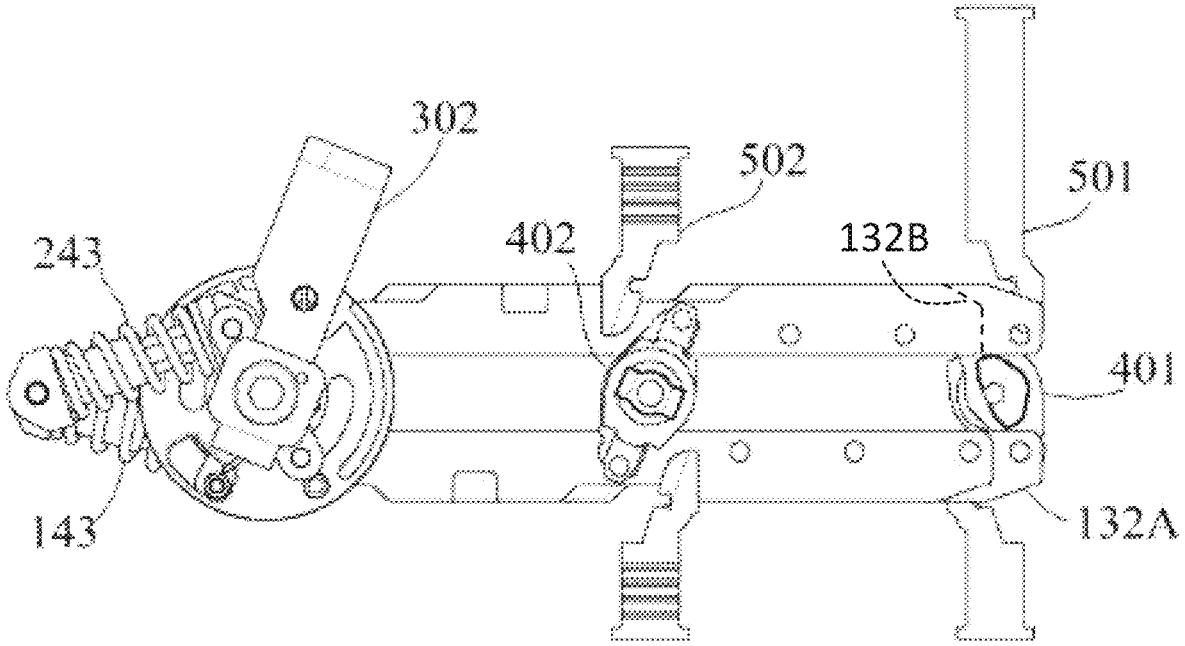
FIG. 7 shows a partial top view of the dual power supply transfer switch in a duel dividing position.
Figure 8:
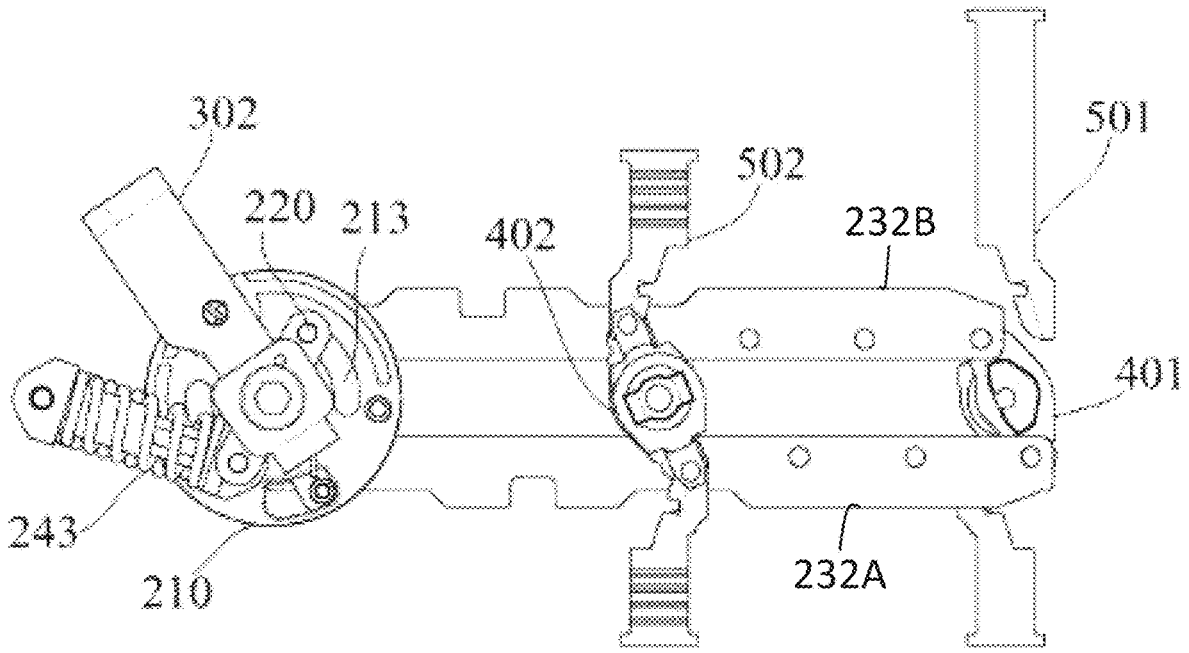
FIG. 8 shows a partial top view of the dual power supply transfer switch in a second power position.

FIG. 6 to FIG. 8 respectively show top views of the dual power supply transfer switch including the switching mechanism according to the present invention at a first power position, a duel dividing position, and a second power position. As shown, the first movable contact 401 and the second movable contact 402 are spaced by a distance. The first movable contact 401 is located on the bottom side of the linkages 132A and 132B of the first actuator 130, and the second movable contact 402 is located on the top side of the linkages 232A and 232B of the second actuator 230.

In the first power position shown in FIG. 6, the linkages 132A and 132B and the linkages 232A and 232B overlap with each other, whereby the first movable contact 401 and the second movable contact 402 have the same first angular orientation. Thus, the first movable contact 401 contacts the first stationary contact 501, thereby turning on the first power supply; while the second movable contact 402 does not contact the second stationary contact 502, thereby turning off the second power supply.

In the duel dividing position shown in FIG. 7, the driving arm 302 has been rotated counterclockwise from the a first angle to a second angle, and the first spring 143 of the first auxiliary mechanism 140 has swung from a first position through the dead point position to a second position. Under the cooperation of the driving arm 302 and the first spring 143, the linkages 132A and 132B (shown in broken lines) move with respect to each other, thereby causing the first movable contact 401 to rotate to a second angular orientation, whereby the first movable contact 401 moves away from the first stationary contact 501 and turns off the first power supply.

In the second power position shown in FIG. 8, the driving arm 302 has been rotated counterclockwise from the a second angle to a third angle, and the second spring 243 of the second auxiliary mechanism 240 has swung from a first position through the dead point position to a second position. Under the cooperation of the driving arm 302 and the second spring 243, the linkages 232A and 232B move with respect to each other, thereby causing the second movable contact 402 to rotate to a second angular orientation, whereby the second movable contact 402 contacts the second stationary contact 502 and turns on the second power supply.

Some preferred embodiments and other embodiments of the present invention have been described in detail, but it is understood that these embodiments are only illustrative, but not limit the scope, the application or the configuration of the invention in any way. The scope of the invention is defined by the appended claims and their equivalents. Those skilled in the art can make many modifications to the foregoing embodiments under the teachings of the present disclosure, all of which fall within the scope of the present invention.

REFERENCE NUMBERS LIST

| | | | |
|---|---|---|---|
| 100 | First switching assembly | 200 | Second switching assembly |
| 110 | First driving plate | 210 | Second driving plate |
| 111 | Notch | 211 | Notch |
| 112 | Protuberance | 212 | Protuberance |
| 113 | First driving groove | 213 | Second driving groove |
| 114 | First receiving slot | 214 | Second receiving slot |
| 115 | First receiving hole | 214 | Second receiving hole |
| 120 | First driving rod | 220 | Second driving rod |
| 130 | First actuator | 230 | Second actuator |
| 131 | Actuating plate | 231 | Actuating plate |
| 132A, B | linkage | 232A, B | linkage |
| 133 | Actuating groove | 233 | Actuating groove |
| 134 | Projection | 234 | Projection |
| 135 | Spacer | 235 | Spacer |
| 136A, B | Positioning hole | 236A, B | Positioning hole |
| 140 | First auxiliary mechanism | 240 | Second auxiliary mechanism |
| 141 | Mounting plate | 241 | Mounting plate |
| 142 | Telescopic rod | 242 | Telescopic rod |
| 143 | First spring | 243 | Second spring |
| 144 | Supporting plate | 244 | Supporting plate |
| 145 | Guiding groove | 245 | Guiding groove |
| 301 | Manual operation part | 302 | Driving arm |
| 303A | First main shaft | 303B | Second main shaft |
| 304 | Main shaft | 305 | Connection block |
| 306 | Connection rod | X | Rotation axis |
| 401 | First movable contact | 402 | Second movable contact |
| 501 | First stationary contact | 502 | Second stationary contact |

What is claimed is:

1. A switching mechanism for a dual power supply transfer switch, comprising:

a first switching assembly, including a first driving plate, a first driving rod, a first actuator and a first auxiliary mechanism; and a second switching assembly, including a second driving plate, a second driving rod, a second actuator and a second auxiliary mechanism;

wherein the first driving plate includes an arc-shaped first driving groove, and the first driving rod extends into the first driving groove;

wherein the first auxiliary mechanism includes a first spring;

wherein the first driving plate is able to rotate under an external force;

wherein the first driving groove bypasses the first driving rod when an end of the driving groove does not contact the first driving rod, and the first driving groove pushes the first driving rod to rotate over a first angle and urges the first spring to deform when the end of the driving groove contacts the first driving rod;

wherein the first spring recovers and drives the first driving rod to rotate over a second angle after the first spring having passed a dead point, thus causing the first actuator turning on or off a first power supply;

wherein the second driving plate includes an arc-shaped second driving groove, and the second driving rod extends into the second driving groove;

wherein the second auxiliary mechanism includes a second spring;

wherein the second driving plate is able to rotate under an external force;

wherein the second driving groove bypasses the second driving rod when an end of the second driving groove does not contact the second driving rod, and the second driving groove pushes the second driving rod to rotate over a first angle and urges the second spring to deform when the end of the second driving groove contacts the second driving rod;

wherein the second spring recovers and drives the second driving rod to rotate over a second angle after the second spring having passed a dead point, thus causing the second actuator turning on or off a second power supply; and wherein the first driving plate and the second driving plate are disposed around one and the same rotation axis, and the first driving plate and the second driving plate are interlocked with each other to rotate together.

2. The switching mechanism according to claim 1, wherein the first driving plate and the second driving plate are interlocked by a connection block having a non-circular section shape, and wherein one portion of the connection block is inserted into a first receiving slot at a center of the first driving plate, and another portion of the connection block is inserted into a second receiving slot at a center of the second driving plate.

3. The switching mechanism according to claim 1, wherein the first driving plate and the second driving plate are interlocked by a connection rod, and wherein one end of the connection rod is inserted into a first receiving hole away from a center of the first driving plate, and the other end of the connection rod is inserted into a second receiving hole away from a center of the second driving plate.

4. The switching mechanism according to claim 1, wherein the first driving plate is connected to a manual operating part for receiving a manually applied external force in order to drive the first driving plate and the second driving plate to rotate together.

5. The switching mechanism according to claim 1, wherein the first driving plate is provided with an automatic operation part for receiving an external force applied by an automatic driving mechanism in order to drive the first driving plate and the second driving plate to rotate together.

6. The switching mechanism of claim 1, wherein the first driving plate is located between the first actuator and the first auxiliary mechanism;

the second driving plate is located between the second actuator and the second auxiliary mechanism; and the first actuator and the second actuator are located between the first driving plate and the second driving plate.

7. A dual power supply transfer switch, comprising a switching mechanism according to claim 1.

8. The switching mechanism according to claim 1, wherein the first driving groove and the second driving groove are offset from each other in the circumferential direction about a rotation axis by an angle such that:

when the first driving groove pushes the first driving rod to rotate over the first angle, the second driving groove bypasses the second driving rod; and when the second driving groove pushes the second driving rod to rotate over the first angle, the first driving groove bypasses the first driving rod.

9. The switching mechanism according to claim 8, wherein the first angle is equal to the second angle and half of the angle that the first driving groove and the second driving groove each extend.

10. The switching mechanism according to claim 1, wherein when the first driving plate and the second driving plate are driven to rotate at a first time, the dual power supply transfer switch is switched from a first position to a duel dividing position, wherein in the first position, the first power supply is turned on and the second power supply is turned off, and in the duel dividing position, the first power supply and the second power supply are both turned off; and when the first driving plate and the second driving plate are driven to rotate at a second time, the dual power supply transfer switch is switched from the duel dividing position to a second position, wherein the first power supply is turned off and the second power supply is turned on in the second position.

11. The switching mechanism according to claim 10, wherein each of the first actuator and the second actuator includes:

an actuating plate having an actuating groove, wherein a corresponding driving rod extends into the actuating groove and can slide along the actuating groove, and wherein the driving rod can drive the actuating plate to rotate when the driving rod contacts one end of the actuating groove; and two linkages each having one end hinged to the actuating plate and the other end connected to a corresponding movable contact, such that the movable contact can rotate with the rotation of the actuating plate, and become connected or disconnected with a stationary contact of a corresponding one of the first power supply or the second power supply.

12. The switching mechanism of claim 11, wherein each of the first auxiliary mechanism and the second auxiliary mechanism includes:

a mounting plate having a center around which a corresponding driving rod rotates;

a telescopic rod having a variable length with a fixed end being rotatably coupled to the mounting plate at a position away from the center and a movable end being coupled to the corresponding driving rod; and a spring disposed between the fixed end and the movable end of the telescopic rod;

wherein the spring is configured such that:

when the telescopic rod rotates closer to a line between the fixed end of the telescopic rod and the center of the mounting plate, the spring deforms and stores a potential energy; and when the telescopic rod rotates further from the line between the fixed end of the telescopic rod and the center of the mounting plate, the spring recovers and releases the potential energy.

* * * * *